US009132991B2

(12) United States Patent
Husmann

(10) Patent No.: US 9,132,991 B2
(45) Date of Patent: Sep. 15, 2015

(54) ELEVATOR SYSTEM HAVING A DOUBLE-DECKER

(75) Inventor: Josef Husmann, Lucerne (CH)

(73) Assignee: Inventio AG, Hergiswil (CH)

( * ) Notice: Subject to any disclaimer, the term of this patent is extended or adjusted under 35 U.S.C. 154(b) by 607 days.

(21) Appl. No.: 13/516,292

(22) PCT Filed: Dec. 1, 2010

(86) PCT No.: PCT/EP2010/068597

§ 371 (c)(1),
(2), (4) Date: Aug. 27, 2012

(87) PCT Pub. No.: WO2011/073030

PCT Pub. Date: Jun. 23, 2011

(65) Prior Publication Data

US 2012/0318614 A1 Dec. 20, 2012

(30) Foreign Application Priority Data

Dec. 15, 2009 (EP) ..... 09179246

(51) Int. Cl.
*B66B 9/00* (2006.01)
*B66B 11/02* (2006.01)
*B66B 1/42* (2006.01)

(52) U.S. Cl.
CPC ..... *B66B 11/0206* (2013.01); *B66B 1/42* (2013.01); *B66B 11/022* (2013.01)

(58) Field of Classification Search
CPC .. B66B 11/022; B66B 11/0206; B66B 1/425; B66B 1/42
USPC ..... 187/249
See application file for complete search history.

(56) References Cited

U.S. PATENT DOCUMENTS

| | | | | |
|---|---|---|---|---|
| 1,805,227 | A * | 5/1931 | Rugg | 187/249 |
| 1,837,643 | A * | 12/1931 | Anderson | 187/249 |
| 1,911,834 | A * | 5/1933 | Lindquist | 187/249 |
| 2006/0191747 | A1 * | 8/2006 | Mustalahti et al. | 187/249 |
| 2007/0289821 | A1 * | 12/2007 | Ach | 187/404 |
| 2008/0093177 | A1 * | 4/2008 | Fargo | 187/249 |
| 2008/0142308 | A1 * | 6/2008 | Kocher | 187/249 |
| 2008/0149427 | A1 * | 6/2008 | Kocher et al. | 187/249 |
| 2009/0301818 | A1 * | 12/2009 | Hashiguchi | 187/249 |
| 2011/0017551 | A1 * | 1/2011 | Aulanko et al. | 187/249 |
| 2011/0031069 | A1 * | 2/2011 | Kocher et al. | 187/247 |
| 2012/0097484 | A1 * | 4/2012 | Cortona et al. | 187/249 |

FOREIGN PATENT DOCUMENTS

| | | | |
|---|---|---|---|
| CA | 2501148 | A1 * | 9/2005 |
| JP | 2007-331871 | A | 12/2007 |

(Continued)

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator system includes an elevator car support displaceable in a travel area provided for the travel of the elevator car support, and a first elevator car and a second elevator car, each car adjustably disposed on the elevator car support. A drive unit is further disposed on the elevator car support. A belt is also provided. The first elevator car and the second elevator car are thereby adjustable in opposite directions by the drive unit by the belt relative to the elevator car support.

13 Claims, 2 Drawing Sheets

(56) References Cited

FOREIGN PATENT DOCUMENTS

| | | | | |
|---|---|---|---|---|
| WO | WO 0238482 | A1 | * | 5/2002 |
| WO | 03/043926 | A1 | | 5/2003 |
| WO | 2007/074206 | A1 | | 7/2007 |
| WO | WO 2013001587 | A1 | * | 1/2013 |
| WO | WO 2014/027398 | A1 | * | 2/2014 |

* cited by examiner

ELEVATOR SYSTEM HAVING A DOUBLE-DECKER

FIELD

The invention relates to an elevator system having at least one elevator car support that can hold two or more elevator cars. The invention relates specifically to the field of elevator systems designed as so-called double-decker elevator systems.

BACKGROUND

JP 2007-331871 A discloses a double-decker elevator. The known elevator has a car frame in which two elevator cars are arranged one vertically above the other. The two elevator cars each stand on a support with sheaves, lifting cables being guided around the sheaves. A drive unit, around which the lifting cable is guided, is moreover provided on the car frame. By actuating the lifting cable by means of the drive unit, the elevator cars suspended in this way can be raised and lowered relative to the car frame. As a result, the two elevator cars can be positioned differently inside the car frame.

The double-decker elevator known from JP 2007-331871 A has the disadvantage that the mechanism provided for suspending and adjusting the elevator cars requires a relatively large amount of space. For example, the sheaves of the top elevator car, on which the top elevator car is suspended, require a certain structural space that, in the case of a predetermined structural space for the car frame, restricts the remaining space for the elevator car both vertically and horizontally. This also applies to the bottom elevator car. Specifically with respect to the architecturally predetermined shaft dimensions, this thus results in a reduced cross-section remaining for the elevator cars, which entails smaller elevator cars. Moreover, the space required vertically is also increased, which imposes additional demands on the design of the elevator shaft in terms of its end regions.

SUMMARY

An object of the invention is to provide an elevator system which has an improved structure. Specifically, an object of the invention is to provide an elevator system in which the space remaining for the elevator cars is optimized and the two elevator cars can be adjusted relative to each other advantageously.

In the design of the elevator system, the elevator car support can advantageously be arranged in an elevator shaft, a drive motor unit being provided which serves to actuate the elevator car support. As a result, the elevator car support can be displaced along the travel path provided. The elevator car support can hereby be suspended from a traction means connected to the elevator car support. The traction means can hereby be guided in a suitable fashion over a drive pulley of a drive motor unit. As well as having the function of transmitting the force or the torque from the drive motor unit to the elevator car support in order to actuate the elevator car support, the traction means can here also have the function of carrying the elevator car support. Actuation of the elevator car support is hereby understood in particular as raising or lowering the elevator car support in the elevator shaft. The elevator car support can thus be guided in the elevator shaft by one or more guide rails.

It is advantageous that sheaves, about which the belt is guided, are attached to the first elevator car, that at least one sheave, about which the belt is guided, is attached to the elevator car support, and that the belt with the sheaves attached to the first elevator car and the sheave attached to the elevator car support forms a pulley system for adjusting the first elevator car. As a result, the torque applied by the drive unit to adjust the first elevator car can be reduced. As a result, the power required by the drive unit can be reduced.

An optimized design is possible as a result of the interaction of the belt with the sheaves. In the case of multiple suspension from a belt, a belt with tension members which have a diameter of 1.7 mm, in combination with a sheave pitch diameter of 87 mm, can for example be formed, the belt height being approximately 3 mm. By way of comparison, in the case of a design with a cable hoist, the cable diameter is for example 8 mm and the pitch diameter of the cable pulley 240 mm. The structural space required is thus considerably reduced.

It is advantageous that the second elevator car is arranged adjustably on the elevator car support, that the second elevator car can be adjusted relative to the elevator car support by the drive unit by means of the belt, and that, when the first elevator car and the second elevator car are adjusted relative to the elevator car support, the first elevator car and the second elevator car can be adjusted in opposing directions of adjustment. Moreover, it is hereby advantageous that sheaves, on which the second elevator car is suspended via the belt, are arranged on the elevator car support. The two elevator cars can thus be adjusted relative to each other simultaneously by driving the belt. Because the two elevator cars are adjusted in opposite directions, the speeds of the adjusting movements of the two elevator cars are added together in terms of a change in the distance between the two elevator cars.

It is advantageous that the belt has a first side and a second side averted from the first side, and that the first side serves as a contact side on which the belt is guided about a drive wheel of the drive unit and about sheaves and with respect to which the belt is deflected, and that the second side serves as a free back side with respect to which the belt is at least substantially not deflected. As a result, reverse deflections in the belt can be at least largely avoided. However, one or more guide sheaves can be provided which interact with the free back side of the belt in order to guide the belt. Such a guide sheave can, for example, be arranged on the elevator car support. Specifically, the belt can be guided in the same direction about the drive wheel and the sheaves. This design is especially advantageous in the case of a profiled belt.

In particular, in the case of the belt being guided in the same direction, a first end of the belt is connected to a cross-member of the elevator car support. The belt is guided from its first end to at least two sheaves which are fastened to the first elevator car. The belt is also guided to at least two sheaves which are fastened to the cross-member. The belt is guided onwards downwards along the side of the first elevator car. Between its first end and the sheaves attached to the cross-member, the belt thus forms a loop in which the first elevator car is suspended. In such a guide arrangement for the belt, the belt is deflected about the sheaves substantially in the same direction.

In a further embodiment of the guidance of the belt in the same direction, two additional sheaves are fastened to the cross-member and two additional sheaves to the first elevator car. The first end of the belt is likewise hereby connected to the cross-member and, as described above, guided to two sheaves on the first elevator car and then to two sheaves on the cross-member, the belt forming a first loop. The belt is guided onwards to the two additional sheaves on the first elevator car and from there to the two additional sheaves on the cross-member. The belt thus forms a second loop in which the first elevator car is suspended. Lastly, the belt is guided downwards along the side of the first elevator car. The arrangement of the additional sheaves on the cross-member and on the elevator car is designed in such a way that the two loops of the belt are guided so that they do not clash. This can be achieved by the additional sheaves on the first elevator car being arranged respectively offset horizontally and/or vertically on the cross-member. Three or more loops can be formed by arranging other sheaves on the cross-member and on the first elevator car.

In a corresponding fashion, the second elevator car can be suspended in the same direction in one or more loops of the belt on a further cross-member. For this purpose, at least two sheaves are fastened to the second elevator car and a second end of the belt is connected to the further cross-member. The belt is guided from its second end to the two sheaves on the second elevator car and from there upwards along the side of the second elevator car. A second and further loops can in each case be formed by means of two additional sheaves on the further cross-member and by means of two additional sheaves on the second elevator car.

It is, however, also advantageous that the belt has a first side and a second side averted from the first side, that the first side serves as a first contact side on which the belt is guided about a drive wheel of the drive unit and about sheaves and with respect to which the belt is deflected, and that the second side serves as a second contact side with respect to which the belt is guided about sheaves and with respect to which the belt is deflected. As a result, the space required for the arrangement of the belt and the sheaves inside the elevator car support can be optimized. A desired pulley system can optionally also be formed with a reduced number of sheaves. This design is especially suitable for a flat belt or a belt that is profiled on both sides.

It is advantageous that the belt has at least one rib on at least one contact side. The rib can specifically hereby have a V-shaped profile. Multiple ribs are preferably formed on the contact side and are each at least approximately V-shaped. Other forms for the profile of the rib are also possible. The rib can, for example, have a trapezoidal profile.

It is also advantageous that a further belt is provided which holds the first and second elevator car from below. A first end of the further belt is hereby connected to the elevator car support and a second end of the further belt is connected to the elevator car support. In particular, each end is connected to a cross-member of the elevator car support. The further belt holds from below the first and second elevator car in each case on two sheaves which are each fastened to an associated elevator car. The further belt thus represents a bottom tensioning means that prevents the first and second elevator car from jumping in the event of an abrupt stop. As a result, even in the event of emergency braking, it is ensured that the first and the second elevator car remain essentially constantly in a stationary position in relation to the elevator car support.

DESCRIPTION OF THE DRAWINGS

Preferred exemplary embodiments of the invention are explained in more detail in the following description with the aid of the attached drawings, in which corresponding elements are provided with matching reference numerals. In the drawings.

DETAILED DESCRIPTION

Figure 1:
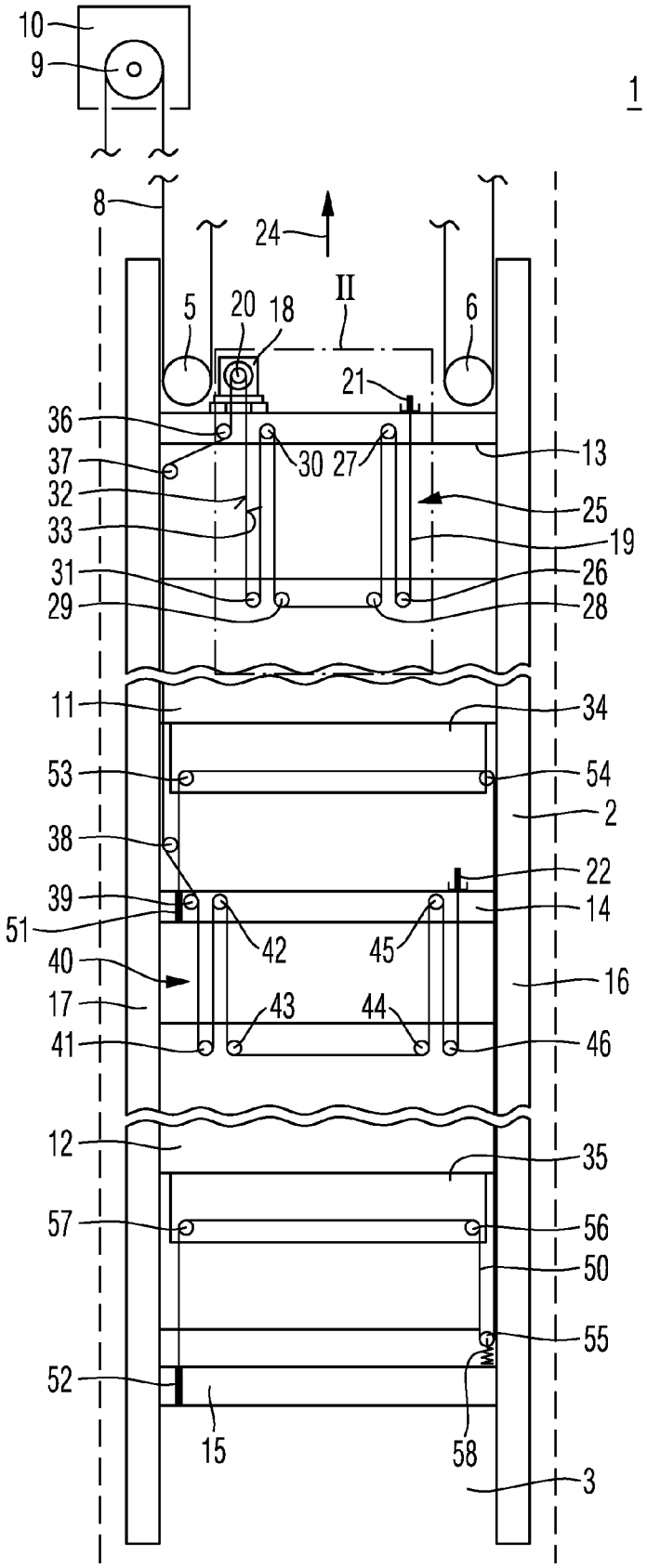
FIG. 1 shows a schematic representation of an elevator system in accordance with a first exemplary embodiment of the invention.

FIG. 1 shows an elevator system 1 with at least one elevator car support 2 which can be displaced in a travel space 3 provided for the travel of the elevator car support 2. The travel space 3 can, for example, be provided in an elevator shaft of a building.

The elevator car support 2 is suspended via multiple sheaves 5, 6 from a traction means 8. For greater clarity, the passage of the traction means 8 between the sheaves 5, 6 has not been shown in FIG. 1. In a common design, the traction means 8 is guided directly from the sheave 5 to the sheave 6. The traction means 8 is moreover guided about a drive pulley 9 of a drive motor unit 10. The elevator car support 2 is displaced upwards or downwards through the travel space according to the current direction of rotation of the drive pulley 9.

A first elevator car 11 and a second elevator car 12 are arranged on the elevator car support 2. The two elevator cars 11, 12 can hereby be adjusted relative to the elevator car support 2.

Cross-members 13, 14, 15, connected to longitudinal members 16, 17 of the elevator car support 2, are formed on the elevator car support 2. The sheaves 5, 6 are arranged on the cross-member 13. Moreover, a drive unit 18 is attached to the cross-member 13. The drive unit 18 serves to drive a belt 19. To do this, the belt 19 is guided about a drive wheel 20 of the drive unit 18. One end 21 of the belt 19 is connected to the cross-member 13. Another end 22 of the belt 19 is connected to the cross-member 14 of the elevator car support 2. A longitudinal direction 24 of the elevator car support 2 is determined according to a direction of travel 24. The longitudinal members 16, 17 of the elevator car support 2 are hereby oriented along the longitudinal direction 24. The cross-members 13 to 15 are arranged between the longitudinal members 16, 17, perpendicularly with respect to the longitudinal direction 24.

In a region 25 between the cross-member 13 and the first elevator car 11, the belt 19 is guided back and forth multiple times between the cross-member 13 and the first elevator car 11. Starting from the fixed end 21, the belt 19 is hereby guided initially counter to the longitudinal direction 24 to a sheave 26 fastened on the first elevator car 11. The belt 19 is then guided about the sheave 26 and in the longitudinal direction 24 to a sheave 27 fastened to the cross-member 13. Moreover, the belt 19 is then guided onwards, counter to the longitudinal direction 24, to a sheave 28 fastened to the first elevator car 11. The belt 19 is guided, transversely with respect to the longitudinal direction 24, from the sheave 28 to a further sheave 29 fastened to the first elevator car 11. The belt 19 is guided from the sheave 29, initially in the longitudinal direction 24, to a sheave 30 fastened to the cross-member 13, and then in the opposite direction to the longitudinal direction 24 to a sheave 31 fastened to the first elevator car 11, and then in the longitudinal direction 24 to the drive wheel 20 of the drive unit 18. The belt 19 is hereby deflected both with respect to its first side 32 and with respect to its second side 33. The first side 32 of the belt 19 is hereby applied to the drive wheel 20 of the drive unit 18, whilst the second side 33 faces away from the drive wheel 20 in the region of the drive wheel 20.

In this exemplary embodiment, the first elevator car 11 is arranged on a first member 34 which is guided in the longitudinal direction 24 on the elevator car support 2. Moreover, the second elevator car 12 is arranged on a second member 35 which is guided in the longitudinal direction 24 on the elevator car support 2.

The belt 19 runs from the drive wheel 20 of the drive unit 18 counter to the longitudinal direction 24 to a guide sheave 36. Moreover, the belt 19 is guided about the guide sheave 36 and further guide sheaves 37, 38. The guide sheaves 36 to 38 are connected to the elevator car support 2. The belt 19 is guided onwards from the guide sheave 38 to a guide sheave 39 which is connected to the cross-member 14.

In a region 40, the belt 19 is guided multiple times in and counter to the longitudinal direction 24. The belt 19 is hereby guided back and forth between the cross-member 14 and the second elevator car 12. The belt 19 thus runs from the guide sheave 39 counter to the longitudinal direction 24 to a sheave 41 which is connected to the second elevator car 12, then in the longitudinal direction 24 to a sheave 42 connected to the cross-member 14, and then counter to the longitudinal direction 24 to a sheave 43 connected to the second elevator car 12. The belt 19 is moreover guided, transversely with respect to the longitudinal direction 24, along the second elevator car 12 from the sheave 43 to a sheave 44 connected to the second elevator car 12. The belt 19 is guided in the longitudinal direction 24 from the sheave 44 to a sheave 45 connected to the cross-member 14, then counter to the longitudinal direction 24 to a sheave 46 connected to the second elevator car 12, and then onwards in the longitudinal direction 24 to the cross-member 14, the end 22 being connected to the cross-member 14.

Moreover, in this exemplary embodiment a further belt 50 is provided which is designed in a corresponding fashion to the belt 19. One end 51 of the belt 50 is hereby connected to the cross-member 14. Another end 52 of the belt 50 is connected to the cross-member 15. In this exemplary embodiment, the belt 50 has the function of holding the first elevator car 11 and the second elevator car 12 from below. Consequently, when for example an emergency braking operation is initiated, whilst the elevator car support 2 moves upwards through the travel space 3, the braking forces are reliably transmitted from the elevator car support 2 to the two elevator cars 11, 12.

Starting from its end 51, the belt 50 is guided in the longitudinal direction 24 about a sheave 53 connected to the first member 34. The belt 50 is then guided, transversely with respect to the longitudinal direction 24, to a further sheave 54 connected to the first member 34. The belt 50 is guided from the sheave 54 counter to the longitudinal direction 24 along the side of and past the second elevator car 12 to a sheave 55. The sheave 55 is hereby connected to the cross-member 15. The belt 50 is guided from the sheave 55 in the longitudinal direction 24 to a sheave 56 connected to the second member 35. The belt 50 is guided from the sheave 56, transversely with respect to the longitudinal direction 24, to a sheave 57. The belt 50 is guided from the sheave 57, counter to the longitudinal direction 24, to the cross-member 15, the end 52 being connected to the cross-member 15.

In this arrangement, the two elevator cars 11, 12 are suspended from the belt 19. A pulley system for the first elevator car 11 is hereby formed in the region 25. A pulley system for the second elevator car 12 is moreover formed in the region 40. Because the two pulley systems have the same transmission ratios, the adjustment travels for the first elevator car 11 and the second elevator car 12 are also the same. The drive unit 18 is also, to a certain extent, arranged between the two pulley system arrangements. Thus, if the length of the belt 19 in the region 25 is shortened, the belt 19 in the region 40 is lengthened, and vice versa. If the first elevator car 11 is adjusted by the pulley system arrangement in the region 25 in the longitudinal direction 24 relative to the elevator car support 2, the second elevator car 12 is thus adjusted relative to the elevator car support 2 counter to the adjusting direction 24. The same applies in reverse. The elevator cars 11, 12 are thus always adjusted in directly opposite directions. It should hereby be noted that the sheaves 27, 30 of the pulley system arrangement in the region 25 are arranged immovably on the elevator car support 2, and that the sheaves 42, 45 are arranged, likewise immovably, on the elevator car support 2 via the cross-member 14. Moreover, coordination with the belt 50 is thus ensured since shortening the belt 50 between the end 52 and the sheave 55 lengthens the distance between the sheave 55 and the end 51 by precisely the required amount. As a result, it can in particular be achieved that a predetermined tensile stress of the belt 50 is always maintained. For this purpose, the sheave 55 can be subjected to the action of a spring element 58.

The belt 19 and the belt 50 serve different functions so that these different loads can be applied. It is hereby possible to adapt to the respective example of application in different ways. For example, it is possible to provide four belts 19, guided in parallel, instead of a single belt 19. It is also possible to provide two belts 50, guided in parallel, instead of a single belt 50. The belts 19, 50 can hereby be guided via sheaves 26 to 31, 41 to 46, 53 to 57 and guide sheaves 36 to 39 which are designed with a corresponding width. As a result, uniformly designed belts can be used as the belts 19, 50. In this embodiment, the belt 19 is deflected both with respect to its first side 32 and to its second side 33. For example, the belt 19 is deflected at the sheave 31 with respect to the second side 33, whilst it is deflected at the sheave 30 with respect to the first side 32. A deflection with respect to both sides 32, 33 thus occurs in the pulley system arrangements in the regions 25, 40. This means that a deflection and a reverse deflection of the belt 19 occur as part of the belt guidance. However, it is hereby possible to optimize the available space and the total required length of the belt 19.

Because the elevator cars 11, 12 are each tensioned between the belts 19, 50, a high degree of stability of the elevator car support 2 with the elevator cars 11, 12 can be obtained. As a result, it is also possible that the first elevator car 11 has a relatively great height and/or that the second elevator car 12 has a relatively great height. The extents of the elevator cars 11, 12 in the longitudinal direction 24 can thus be preset to be relatively great. Moreover, a lateral spacing of the elevator cars 11, 12 from the longitudinal members 16, 17 can be reduced. It is hereby also advantageous that the belt 19 or the belt 50 can be guided close to the longitudinal members 16, 17, as a result of which the remaining space for the elevator cars 11, 12 is increased further. A large part of the available shaft cross-section in the travel space 3 can thus be used by the elevator cars 11, 12.

Figure 2:
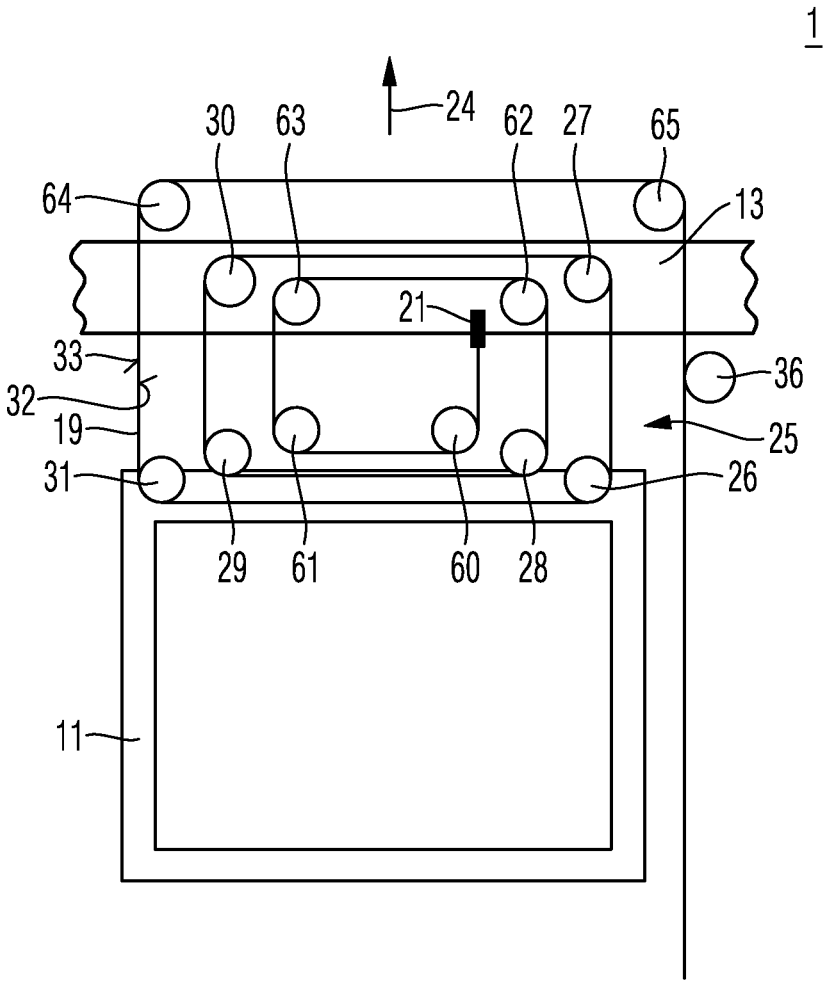
FIG. 2 shows a schematic representation of the section of an elevator system which is labeled II in FIG. 1 in accordance with a second exemplary embodiment.

FIG. 2 shows a schematic representation of the section of the elevator system 1 which is labeled II in FIG. 1 in accordance with a second exemplary embodiment. In this exemplary embodiment, a further sheave 60 is arranged next to the sheaves 26, 28 on the first elevator car 11. Furthermore, a further sheave 61 is arranged next to the sheaves 29, 31, on the first elevator car 11. Moreover, a further sheave 62 is arranged next to the sheave 27 on the cross-member 13. Furthermore, a further sheave 63 is arranged next to the sheave 30 on the cross-member 13. In this exemplary embodiment, an alternative guidance of the belt 19 in the region 25 is shown for implementing a pulley system. In this pulley system arrangement, the belt 19 is guided clockwise from its end 21 about the sheave 60, then the sheave 61, the sheave 63, the sheave 62, the sheave 28, the sheave 29, the sheave 30, the sheave 27, the sheave 26, the sheave 31, a guide sheave 64 arranged on the cross-member 13, and then a guide sheave 65 which is also arranged on the cross-member 13. The belt 19 is then guided from the guide sheave 65 counter to the longitudinal direction 24 downwards along the side of the first elevator car 11. A pulley system arrangement is thus formed in the region 25, in which the belt 19 bears always with its first side 32 against the individual sheaves 26, 27, 28, 29, 30, 31, 60, 61, 62, 63, 64, 65. The belt 19 is thus always deflected with respect to its first side 32. Reverse deflections are thus avoided or at least substantially avoided. The belt 19 can, however, also bear against individual guide sheaves 36 with its second side 33 and thus also be deflected somewhat with respect to the second side 33. The guide sheave 64 can also be replaced by the drive wheel 20 of the drive unit 18.

The belt 19 can thus only be guided on the first side 32 serving as the front side 32, the second side 33 serving as a free back side 33. Depending on the design of the belt 19, the load on the belt 19 can consequently be reduced.

A pulley system arrangement can be formed in a corresponding fashion in the region 40 of the second elevator car 12.

Figure 3:
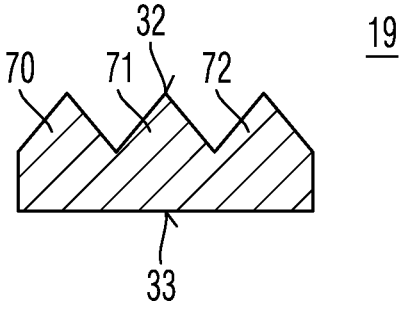
FIG. 3 shows a schematic representation of the profile of a belt for an elevator system in accordance with a possible design.

FIG. 3 shows a schematic representation of a profile of the belt 19 in accordance with a possible design. The belt 19 can be designed as a V-ribbed belt and have multiple ribs 70, 71, 72. Each of the ribs 70 to 72 can hereby have an approximately V-shaped cross-section. In this exemplary embodiment, the design with ribs 70 to 72 is provided on the first side 32. The second side 33 is flat in design. The belt 19 is thus profiled on one side, the first side 32. The first side 32 hereby serves as a contact side. A belt of this type is used, for example, in the second exemplary embodiment illustrated with the aid of FIG. 2.

The belt 19 can alternatively also be profiled on both sides 32, 33. Ribs can hereby be formed on the second side 33 as well, in a corresponding fashion to the ribs 70 to 72. A belt 19 of this type is preferably used in the first exemplary embodiment described with the aid of FIG. 1.

It is moreover possible that a belt 19 designed as a flat belt 19 is used. In the case of such a flat belt 19, the first side 32 is also flat in design. The first side 32 is then hereby designed in a corresponding fashion to the second side 33, as illustrated in FIG. 3. However, a certain surface structure can hereby be provided in order to improve the friction when the belt interacts with the drive wheel 20 of the drive unit 18. In this embodiment, either one of the sides 32, 33 or both sides 32, 33 can thus serve as contact sides.

Moreover, the belt 19 can also be designed as a toothed belt 19.

In the case of a belt 19 that is flat in design on at least one of its sides 32, 33, the flat side 32, 33 is preferably guided over a crowned sheave or the like. The guide surface of the crowned sheave is hereby convex in design. Also, the convex guide surface is preferably bordered by lateral shoulders in order to guide the belt 19.

The invention is not limited to the exemplary embodiments described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system has an elevator car support displaceable in a travel space provided for the travel of the elevator car support, a first elevator car adjustably arranged on the elevator car support, a second elevator car arranged on the elevator car support, a drive unit arranged on the elevator car support, and at least one belt, comprising:

the drive unit driving the at least one belt;

the at least one belt being coupled to the first elevator car wherein the first elevator car is adjustable relative to the elevator car support by the drive unit driving the at least one belt;

another belt having one end connected to the elevator car support and another end connected to the elevator car support, the another belt holding the first elevator car and the second elevator car from below; and wherein starting at the one end, the another belt is guided upwards to sheaves fastened to the first elevator car, is guided onwards downwards along a side of the second elevator car to a sheave fastened to cross-member, is guided onwards upwards to two sheaves fastened to the second elevator car, and is guided onwards to the another end, the first elevator car and the second elevator car each being held from below in a loop of the another belt.

2. The elevator system according to claim 1 including a plurality of sheaves about which the at least one belt is guided, at least one sheave of the plurality of sheaves being attached to the elevator car support, and at least one other sheave of the plurality of sheaves being attached to the first elevator car, wherein the at least one sheave and the at least one other sheave form a pulley system for adjusting the first elevator car relative to the car support.

3. The elevator system according to claim 1 wherein the second elevator car is arranged adjustably on the elevator car support and is adjustable relative to the elevator car support by the drive unit driving the at least one belt, wherein the first elevator car and the second elevator car are adjustable in opposing directions.

4. The elevator system according to claim 3 including sheaves, on which the second elevator car is suspended via the at least one belt, are arranged on the elevator car support.

5. The elevator system according to claim 1 wherein the at least one belt has a first side and a second side opposite the first side, wherein the first side is a contact side on which the at least one belt is guided about a drive wheel of the drive unit and about a plurality of sheaves deflecting the at least one belt.

6. The elevator system according to claim 5 wherein a first end of the at least one belt is connected to a cross-member of the elevator car support, the at least one belt being guided from the first end to at least two sheaves that are fastened to the first elevator car, the at least one belt also being guided to at least two other sheaves that are fastened to the cross-member, wherein the at least one belt then is guided downwards along a side of the first elevator car, and between the first end and the at least two other sheaves attached to the cross-member, the at least one belt forming a loop in which the first elevator car is suspended, the at least one belt being deflected about the sheaves substantially in a same direction.

7. The elevator system according to claim 5 including at least one guide sheave interacting with a free back side of the at least one belt to guide the at least one belt.

8. The elevator system according to claim 1 wherein the at least one belt has a first side and a second side opposite the first side, the first side being a first contact side on which the at least one belt is guided about a drive wheel of the drive unit and about sheaves and with respect to which the at least one belt is deflected, and wherein the second side being a second contact side on which the at least one belt is guided about other sheaves deflecting the at least one belt.

9. The elevator system according to claim 1 wherein the at least one belt has at least one rib on a contact side.

10. The elevator system according to claim 9 wherein the at least one rib has an at least approximately V-shaped profile.

11. The elevator system according to claim 1 wherein the at least-one belt is a flat belt.

12. The elevator system according to claim 1 wherein the sheave fastened to the cross-member is connected to a spring element to maintain a predetermined tensile stress on the at least one belt.

13. An elevator system has an elevator car support displaceable in a travel space provided for the travel of the elevator car support, a first elevator car adjustably arranged on the elevator car support, a second elevator car arranged on the elevator car support, a drive unit arranged on the elevator car support, and at least one belt, comprising:

the drive unit driving the at least one belt;

the at least one belt being coupled to the first elevator car wherein the first elevator car is adjustable relative to the elevator car support by the drive unit driving the at least one belt;

wherein the at least one belt has a first side and a second side opposite the first side, wherein the first side is a contact side on which the at least one belt is guided about a drive wheel of the drive unit and about a plurality of sheaves deflecting the at least one belt, and the second side is a free back side maintained out of contact with the drive wheel and the plurality of sheaves; and at least one guide sheave interacting with the free back side of the at least one belt to guide the at least one belt.

* * * * *